US006969271B2

(12) United States Patent
Hernandez et al.

(10) Patent No.: US 6,969,271 B2
(45) Date of Patent: Nov. 29, 2005

(54) SNAP PIN CONNECTOR

(75) Inventors: Omri Hernandez, Chihuahua (MX); Jorge Gutierrez, Chihuahua (MX)

(73) Assignee: Visteon Global Technologies, Inc., Van Buren Township, MI (US)

( * ) Notice: Subject to any disclaimer, the term of this patent is extended or adjusted under 35 U.S.C. 154(b) by 57 days.

(21) Appl. No.: 10/238,230

(22) Filed: Sep. 10, 2002
(Under 37 CFR 1.47)

(65) Prior Publication Data

US 2004/0048509 A1 Mar. 11, 2004

(51) Int. Cl.[7] ..... H01R 11/20
(52) U.S. Cl. ..... 439/397; 439/408
(58) Field of Search ..... 439/397, 398, 439/400, 404, 405, 680, 862, 891, 637, 80, 439/82, 83

(56) References Cited

U.S. PATENT DOCUMENTS

| | | | | |
|---|---|---|---|---|
| 1,334,084 A | | 3/1920 | Dorsey | |
| 2,145,596 A | | 1/1939 | Grant | |
| 3,048,812 A | | 8/1962 | Heidler | |
| 3,323,102 A | * | 5/1967 | Minor | 439/862 |
| 4,209,217 A | * | 6/1980 | Gudaitis et al. | 439/372 |
| 4,330,164 A | * | 5/1982 | Pittman et al. | 439/293 |
| 4,449,767 A | * | 5/1984 | Weidler | 439/64 |
| 4,591,225 A | * | 5/1986 | Squitieri | 439/404 |
| 4,679,879 A | | 7/1987 | Triner et al. | |
| 4,734,053 A | | 3/1988 | Imai | |
| 4,847,588 A | | 7/1989 | Doutrich | |
| 4,857,019 A | | 8/1989 | Brubaker et al. | |
| 4,906,198 A | | 3/1990 | Cosimano et al. | |
| 4,969,825 A | | 11/1990 | Enomoto et al. | |
| 5,098,311 A | | 3/1992 | Roath et al. | |
| 5,137,477 A | | 8/1992 | Wright | |
| 5,193,271 A | * | 3/1993 | Kato | 29/885 |
| 5,306,177 A | * | 4/1994 | Burke et al. | 439/395 |
| 5,345,214 A | | 9/1994 | Tsui | |
| 5,417,590 A | | 5/1995 | Dechelette et al. | |
| 5,490,800 A | | 2/1996 | Benes et al. | |
| 5,599,213 A | * | 2/1997 | Frommer et al. | 439/857 |
| 5,863,217 A | | 1/1999 | Ii et al. | |
| 6,312,288 B1 | * | 11/2001 | Genz et al. | 439/628 |
| 6,435,804 B1 | * | 8/2002 | Hutchins | 414/540 |

* cited by examiner

*Primary Examiner*—P. Austin Bradley
*Assistant Examiner*—Phuongchi Nguyen
(74) *Attorney, Agent, or Firm*—Brinks Hofer Gilson & Lione

(57) ABSTRACT

A printed circuit board interconnect assembly for use in an automobile comprising a male portion and a female portion. The female portion of the interconnect assembly contains crimped spring clip terminals inside a plastic housing. The male portion of the interconnect assembly contains male pins held together by a plastic housing. The male pins are angled at their mating ends to engage and be retained by the female spring clip terminals.

8 Claims, 3 Drawing Sheets

SNAP PIN CONNECTOR

BACKGROUND OF THE INVENTION

1. Field of the Invention

The present invention relates to connectors and specifically connectors that provide a printed circuit board connection that with higher retention forces.

2. Background and Description of the Prior Art

Printed circuit boards are used in many electrical components in an automobile. Multiple circuit boards are used on components for varying reasons. Sometimes the vehicle packaging restricts the length of the component, so two circuit boards almost on top of each other will be used. Some types of circuits (such as digital and analog) can interfere with each other and will need to be on separate circuit boards with shielding in between. There are many other reasons for multiple circuit boards within a component, but they all face the same challenge: reliably connecting the boards to each other without adding too much cost. This connecting is done with pin and terminal interconnects.

Interconnects between circuit boards tend to be a weak point in an electronic module system. The vehicle environment can be very harsh, including vibration and shock exposure. Repeated vibration and shock can to loosen the interconnects over time. If an interconnect comes loose, the electronic module will likely have reduced or no function, potentially causing the vehicle to break down.

To prevent circuit board interconnects from loosening over time, plastic locks are often added to the housing of the interconnect. These locks are generally a plastic piece added to the housing of the male portion of the interconnect that locks over the top of the female portion of the interconnect. While this added lock normally prevents the interconnect from coming loose in the module, it is an added piece and adds cost to the interconnect system and module.

Interconnect manufacturers currently produce several different designs of interconnects pins, such as zigzagged pins, in an attempt to increase the retention of the female terminal without using the expensive plastic lock. While these different contact designs increase the retention force over straight pins, they are complicated and expensive to manufacture and still achieve less than sufficient retention forces to eliminate the plastic lock in the automotive environment.

From the above, it can be seen that there still is the need exists for a low cost, reliable and simple interconnect system that will not loosen under normal vehicle operating conditions.

SUMMARY OF THE INVENTION

In accordance with the present invention, these and other objects are accomplished by providing an improved interconnect system with higher retention forces that utilizes straight pins.

The present invention uses substantially straight, square pins on the male side of the interconnect that mate with crimped terminals on the female side of the interconnect. The tips of the male pins are generally chamfered to ease insertion forces and to prevent damage to both the male tip and female spring clip terminal because of sharp tips. The straight pins of the male side of the interconnect are generally fixed to the circuit board, mainly by soldering, and include angled ends. Internal to the housing, the female side of the interconnect contains crimped spring clip terminals. The angle of the end of the straight pins of the interconnect follows the shape of the spring clip terminal of the female side. Because the angled end of the male pin fits nearly exactly with the female crimped terminal design, retention is very high and additional plastic locks on the interconnect are not needed.

In another embodiment of the present invention, the straight pin on the male side of the interconnect is bent at the angle of the female crimped terminal design, but instead of ending at that angle as described above, the pin bends back so it ends as in the original direction of the base of the straight pin. The end result is similar to a bump just before the end of the pin. This bump defines an angle that matches the angle of the female spring clip terminal shape, providing improved retention over the prior art.

In a further embodiment of the present invention, the straight pin on the male side of the interconnect has a protrusion on the end of the pin to aid retention. The protrusion includes surfaces angled on the leading side to ease insertion into the female side of the interconnect. The trailing surface of the protrusion is angled to the mate with the internal spring clip angle of the female side of the interconnect.

Additional benefits and advantages of the present invention will become apparent to those skilled in the art to which the present invention relates from the subsequent description of the preferred embodiments and the appended claims, taken in conjunction with the accompanying drawings.

DETAILED DESCRIPTION OF THE PREFERRED EMBODIMENT

Figure 1:
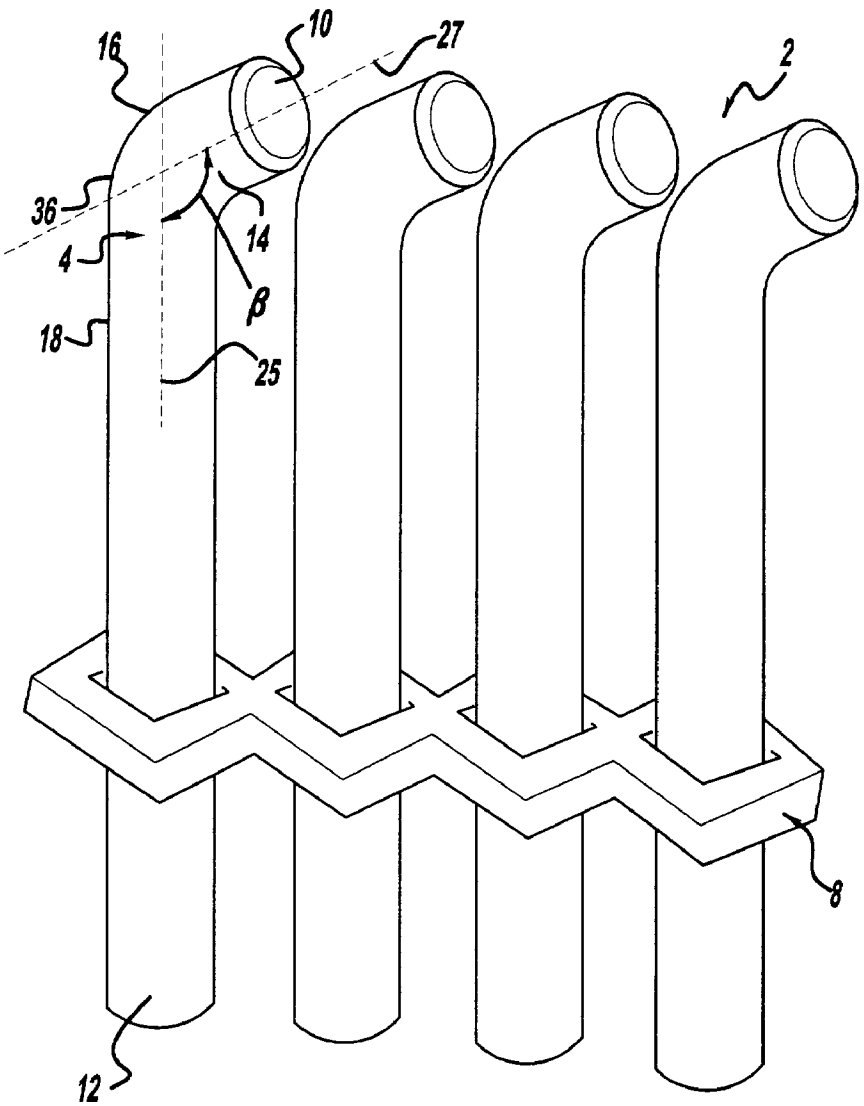
FIG. 1 is a perspective view of the male pin of the interconnect system of the present invention.

Referring now in detail to the drawings, shown in FIG. 1, a male interconnect assembly 2 is shown. A plurality of male pins 4 are attached in parallel to each other by plastic holder or retainer 8.

The male pins 4 start at one end, a first end, 12, and extend in a straight portion 18 to pin bend start point 36. The pin 4 then bends at pin angle β, ending at pin tip 10. Pin angle β is measured from center axis 25, which runs through the center of straight portion 18 to angle axis 27, which runs through the center of pin tip 10. The pin tip 10 outboard surface 16 is curved to meet the pin angle β, as is the pin tip inside 14. The pin angle β corresponds with an angle Ω defined on the female side of the interconnect (shown in FIG. 6).

Holder 8 surrounds the four sides of square pins 4 towards the first end 12. Holder 8 secures the pins 4 a predetermined distance from each other for two reasons. First, the pins 4 must be in a predetermined location so the pins 4 will fit precisely into the female side of the interconnect assembly. Second, to fit into the through holes in the printed circuit board for soldering.

Figure 2:
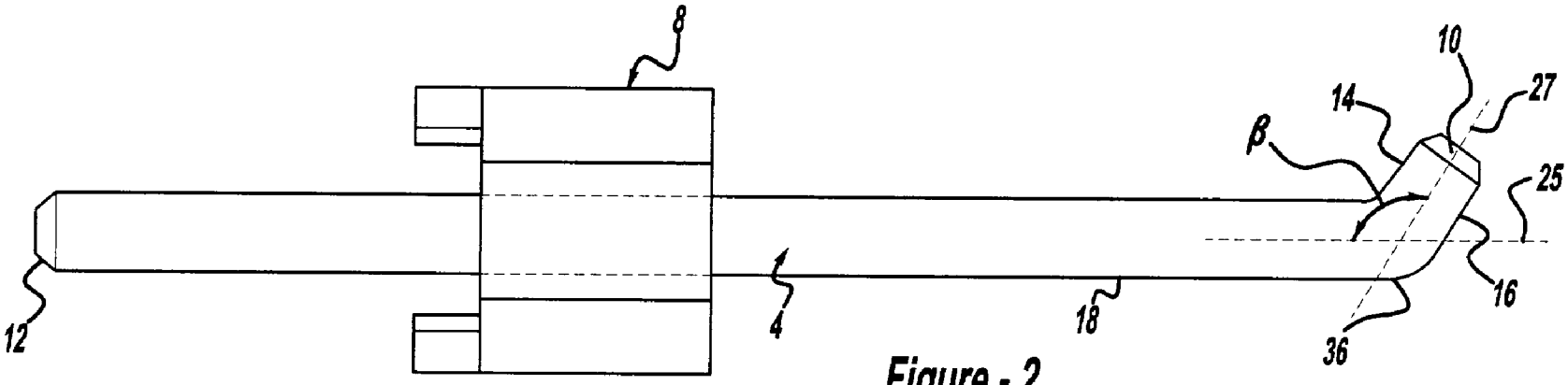
FIG. 2 is a side view of the male pin as seen in FIG. 1.

Referring now to FIG. 2, the preferred embodiment of the present invention is shown in a side view. The plastic holder 8 surrounds the male pin 4 and connects it to other male pins 4 as was shown in FIG. 1. This holder 8 keeps the pins 4 together for insertion of the first end 12 into the printed circuit board for soldering.

The male pin 4 runs straight from the first end 12 along the length of the straight portion 18 to the pin bend point 36. At pin bend point 36, the male pin 4 ceases to run straight and ends at the angled pin tip 10. Angle β is measured from center axis 25, which runs parallel to pin straight portion 18 to angle axis 27. Pin angle β corresponds to the inside angle Ω of the female terminal 57 of the mating female connectors (shown in FIG. 6). In the preferred embodiment of the present invention, pin angle β is 121°, as is inside angle Ω of the female terminal 57. The male pin 4 is bent to angle β. The male pin 4 then runs straight again at angle β through second straight portion along outboard surface 16 and ends at pin tip 10.

Figure 3:
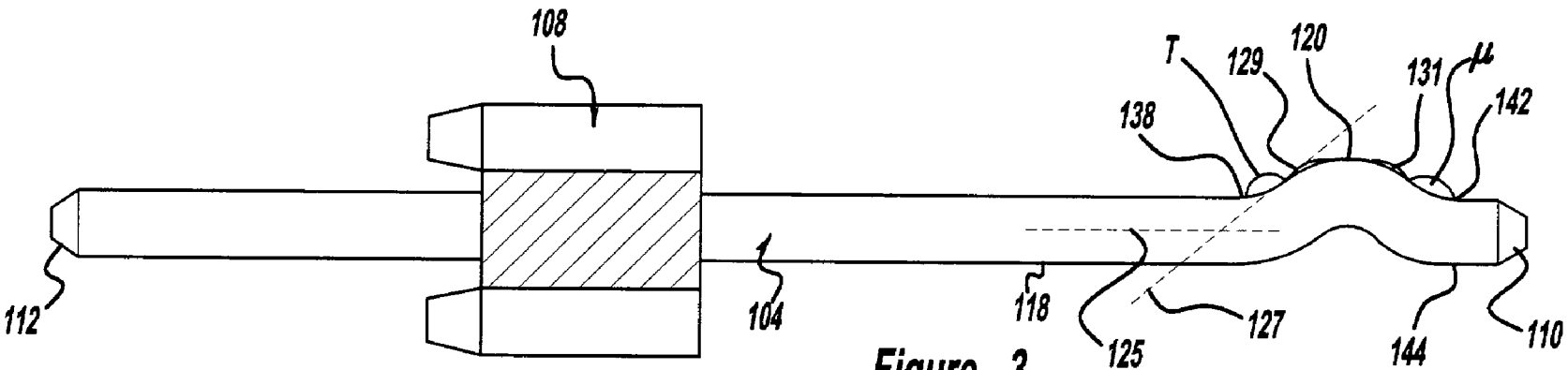
FIG. 3 is a side view of another embodiment of the present invention.

Referring now to FIG. 3, another embodiment of the male pin 104 of the present invention is shown. Similar to the first embodiment, male pin 104 is surrounded by plastic holder 108 to connect it with other male pins 104. The male pins 104 extend in a straight manner from a first end 112 along the straight portion 118 to bend start point 138.

Bump trailing angle λ is measured from horizontal line 125, which is parallel with pin straight portion 118 to bump axis 127, which is consistent with arc 129. Beginning at start point 138, the male pin 104 then bends upwards at bump trailing angle λ along arc 129 until it reaches bump top 120. Angle 129 corresponds with inside angle Ω shown in FIG. 6.

Bump leading angle $\mu$ is measured from horizontal line 125, which is parallel with pin straight portion 118. The male pin 104 then bends downward at bump leading angle $\mu$ along arc 131 until it reaches bump end point 142. The male pin 104 then has a second straight portion 144. The second straight portion 144 extends in a straight manner until it reaches pin tip 110. Pin tip 110 is chamfered to ease insertion into the female interconnect.

Figure 4:
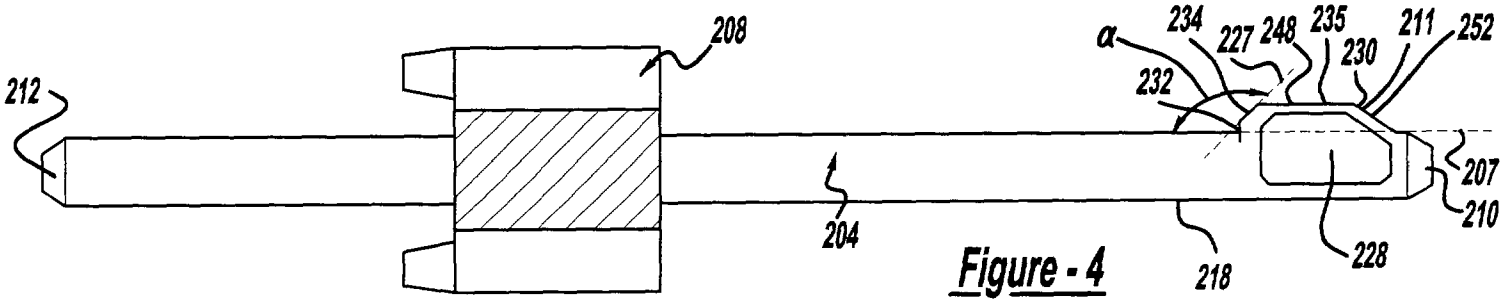
FIG. 4 is a side view of a further embodiment of the present invention.

Referring now to FIG. 4, a further embodiment of the present invention is shown therein. As in the previous embodiments, a series of male pins 204 are again held relative to one another by a plastic retainer 208. The retainer 208 locates the pins 204 for proper positioning in the printed circuit board, where they may be soldered into place.

The male pin 204, extends from a first end 212, the mounting end, in a straight portion 218 to an opposing or engaging or second end 210. A protrusion 235 is formed on the second end 210.

Figure 6:
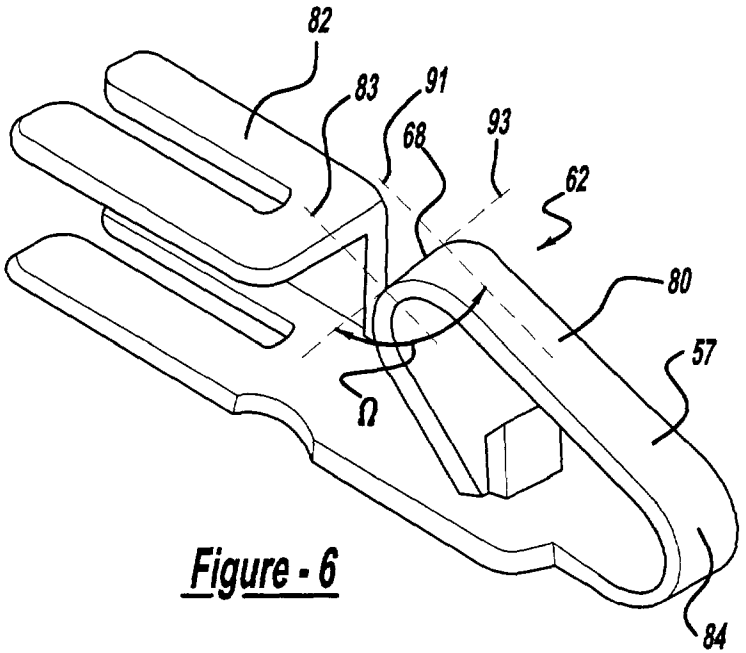
FIG. 6 is a perspective view of a spring clip terminal on the female side of the interconnect system according to the present invention.

The protrusion 235 includes a shoulder 232 defining a trailing surface generally perpendicular to the straight portion 218 from the shoulder 232. From the shoulder 232, a surface 234 angles upward towards to a top surface 248, which is generally parallel to the straight portion 218. Along this rising surface 234, pin angle α is formed from center axis 207, which runs parallel to straight portion 218, and angle axis 227, which runs parallel to surface 234. Angle α corresponds with angle Ω of the female terminal, as seen in FIG. 6. At the end of top surface 248, the top surface 248 becomes the leading surface 230, angling back toward and merging with the straight portion 218 at the break point 252. Thereafter, the pin 204 terminates in a chamfered tip 210 that is coaxial with the straight portion 218.

Formed in the protrusion 235 is a boss opening or cutout 228. The cutout 228 allows the leading edge 252 and top surface 248 to compress towards the straight portion 218 of the pin 204 as the pin 204 is inserted into the female terminal 54. Once fully inserted into the female terminal 54, the leading and top surfaces 230, 248 will spring back to the original shape.

Figure 5:
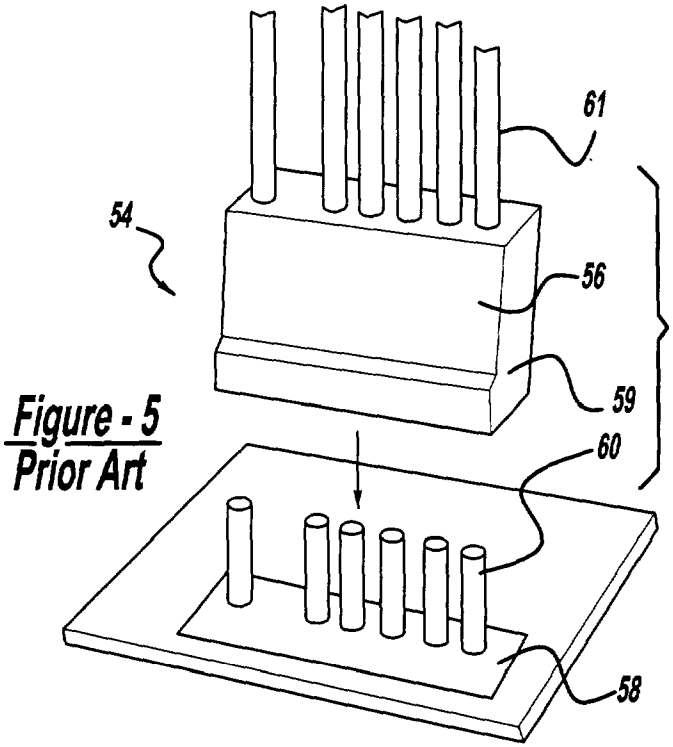
Figure - 5 Prior Art
FIG. 5 is a perspective view of an interconnect system of the prior art.

Referring now to FIG. 5, the prior art interconnect system 54 is shown perspectively. Prior art straight pins 60 extend from the bottom of male connector 58. The prior art female side 56 contains crimped terminals therein, which are crimped to flexible cable 61 within the housing 56. The female side interconnect 56 slides over the prior art male side 58, using prior art straight pins 60 as guides. The interconnects are then connected or retained by friction.

Referring now to FIG. 6, one embodiment of a female crimped terminal 57 is shown. In this version, a cantilever contact terminal 62 is perspectively shown as is used in the female side of the interconnect. The contact 62 extends from its rounded start point 84 along straight length 80. The contact 62 then bends in a cantilevered fashion at contact top 68. An angle Ω is formed between straight axis 91, which runs parallel to straight length 80 and top axis 93 which runs perpendicular to contact top 68. Angle Ω should be the same as angles β, λ, and α from FIGS. 2 through 4. The attachment portion 82 is secured within the female housing 56 (shown in FIG. 5). During insertion, the present invention male pin 4 (shown in FIG. 2) will slide past the rounded start point 84 and along the length of straight length 80. The male pin 4 will be fully inserted when it locks over the cantilever contact top 68. The male pin 4 will then be held in place over cantilever contact top 68 during normal vehicle operating conditions.

While the above description constitutes the preferred embodiments of the present invention, it will be appreciated that the invention is susceptible to modification, variation and change without departing from the proper scope and fair meaning of the accompanying claims.

We claim:

1. An interconnect assembly for printed circuit boards used in automotive vehicles, said assembly comprising:

a female portion including a housing containing a plurality of female terminals, said female terminals defining an insertion axis and having a spring clip portion oriented along said insertion axis and a contact top where the spring clip portion bends to create a first angle between the insertion axis and contact top bend; and a male portion of an interconnect containing a plurality of male pins with a first straight portion on said pins surrounded by a housing at a bottom end of said pins, an arced portion on a mating end of said pin wherein the rise in the male pin surface along said arced portion creates a second angle on said male portion that is substantially similar to said first angle in said female portion and a second straight portion, after the arced portion, ending at the pin tip.

2. The male pins of claim 1 wherein said pins are substantially square.

3. The interconnect assembly of claim 1 wherein said first angle is 121 degrees and said second angle is 121 degrees.

4. An interconnect assembly for printed circuit boards used in automotive vehicles, said assembly comprising:

a female portion including a housing containing a plurality of female terminals, said female terminals defining an insertion axis and having a spring clip portion oriented along said insertion axis and a contact top where the spring clip portion bends to create a first angle between the insertion axis and contact top bend; and a male portion of an interconnect containing a plurality of male pins with a straight portion on said pins surrounded by a housing at a bottom end of said pins and a protruding portion on a mating end of said pin wherein the protruding portion contains an angled surface on a trailing side of said protruding portion that is angled up from the straight portion of said male pin wherein the angled surface and the straight portion create a second angle on said male portion that is substantially similar to said first angle in said female portion.

5. The male pins of claim 4 wherein said protruding portion is cut out in its center to allow compression of said protruding portion during insertion into said female mating interconnect.

6. The male pins of claim 4 wherein said protruding portion is angled on a leading edge to allow easier insertion to said mating female interconnect.

7. The male pins of claim 4 wherein said pins are substantially square.

8. The interconnect assembly of claim 4 wherein said first angle is 121 degrees and said second angle is 121 degrees.

* * * * *